United States Patent [19]

Schap

[11] Patent Number: 5,066,056

[45] Date of Patent: Nov. 19, 1991

[54] POWER STRIKER FOR AUTOMOTIVE DOOR LATCH

[75] Inventor: William W. Schap, Muskegon, Mich.

[73] Assignee: ITT Corporation, New York, N.Y.

[21] Appl. No.: 587,294

[22] Filed: Sep. 24, 1990

[51] Int. Cl.[5] ..... E05B 15/02

[52] U.S. Cl. ..... 292/341.16; 292/DIG. 23

[58] Field of Search ..... 292/144, 201, 341.16, 292/341.15, DIG. 43, DIG. 23

[56] References Cited

U.S. PATENT DOCUMENTS

| | | | |
|---|---|---|---|
| 4,707,007 | 11/1987 | Inoh | 292/216 |
| 4,775,178 | 10/1988 | Borko | 292/341.16 |
| 4,796,932 | 1/1989 | Tame | 292/DIG. 43 |
| 4,842,313 | 6/1989 | Boyko et al. | 292/341.16 |
| 4,862,640 | 9/1989 | Boyko et al. | 49/214 |
| 4,984,385 | 1/1991 | Deland | 292/DIG. 23 |
| 5,004,280 | 4/1991 | Schap | 292/341.16 |

*Primary Examiner*—Eric K. Nicholson
*Assistant Examiner*—Darwell Boucher
*Attorney, Agent, or Firm*—Robert P. Seitter; J. Gordon Lewis

[57] ABSTRACT

A power striker pin mechanism utilizes a base plate having a horizontal guide slot in its front side surface and a vertical guide slot in its rear side surface. A striker pin carrying slider is slidably received in the horizontal slot and is formed with a cylindrical post portion which projects rearwardly of the slider through a clearance opening in the base plate and through the vertical slot at the rear side of the base plate. A circular cam is located in the vertical slot and formed with an eccentric bore which rotatively receives the post portion of the slider. The circular cam is mounted upon a guide member for rotation relative to the guide member about its center and the guide member in turn is mounted for movement vertically relative to the base plate within the vertical slot. A flexible cable fixed at one end to the cam is tensioned to apply a torque to the cam. The rotative forces so applied to the cam are transformed into horizontal and vertical movement of the striker pin carrying slider and cam carrying guide member respectively by the horizontal and vertical guide slots of the base member.

18 Claims, 7 Drawing Sheets

POWER STRIKER FOR AUTOMOTIVE DOOR LATCH

BACKGROUND OF THE INVENTION

The present invention, although useful in other applications, is especially directed to power driven striker mechanisms utilized in automotive door latches to achieve a controlled powered movement of the door to its fully closed position.

A typical standard automotive door latch assembly includes a striker which usually takes the form of a pin fixedly mounted in the door frame to project into the door opening into the path of movement of a latch member mounted on the edge of the door. In a typical arrangement, the latch member will be pivotally mounted upon the door and so arranged that as the door approaches its closed position, the latch member will engage the striker pin and further closing movement of the door will pivot the latch member into a latched engagement with the pin which positively retains the door against movement away from its closed position. Typically, at least part of the movement of the latch member into latched relationship with its striker is resisted by a spring, and to be sure that the door is fully latched, most people will habitually close the door with far greater force than necessary. This problem is especially acute in the case of sliding doors, such as those employed on vans where movement of the door during the final phase of its movement to its fully closed position must compress a resilient door seal which extends around the entire periphery of the door opening.

To overcome this problem, powered strikers are mounted on the door frame for powered movement between an outboard (with respect to the vehicle centerline) ready position at which the latch is latched to the striker and a inboard holding position in which the striker holds the latched door in its fully closed position. Examples of such arrangements are found, for example, in U.S. Pat. Nos. 4,707,007 and 4,862,640. When the door is open, the striker pin is located in its outboard ready position. Upon closure of the door, the latch on the door engages striker pin and latches the door to the striker pin while the striker pin is in its outboard position. At this time, the door may engage a limit switch on the door frame to actuate a drive motor which, through appropriate mechanism, drives the striker pin to its inboard position, the latched engagement between the door and striker pin enabling the pin to drive the door to its fully closed position. With this arrangement, only a closing force sufficient to engage the latch need to be applied, the powered movement of the striker pin providing the force necessary to compress the door seal.

The striker pin driving mechanism must be mounted in the interior of a channel shaped frame structure which defines one vertical edge of the door opening, and the space available for mounting the mechanism and access to this space is sometimes extremely restricted. A second problem encountered by such mechanisms is that of designing the mechanism in a manner such that external forces applied to the striker pin are absorbed insofar as is possible by the vehicle frame rather than by the striker pin positioning mechanism. While the closing force applied to the door need only be enough to actuate the latch, this force is frequently substantially exceeded. These impact forces and other types of shock loading applied to the vehicle door frame can, when absorbed by the mechanism, damage or backdrive the pin positioning mechanism. For proper operation of the latch, alignment of the striker with the path of movement of the door carried latch is critical. Because the resistance of the door seal to closing movement of the door increases as the door approaches it fully closed position, desirably the striker pin driving mechanism should operate at a maximum mechanical advantage as the pin approaches its inboard limit of movement.

The present invention provides a powered striker mechanism which effectively transmits external forces applied to the striker pin to the vehicle frame rather than to movable elements of the striker pin drive mechanism, applies the driving force of a rotary drive input to the striker pin with a mechanical advantage which increases as the striker pin approaches its inboard end limit, and achieves these results by a mechanism well adapted to be mounted within a restricted space. The striker pin mechanism of the present invention is also constructed in a manner which accommodates vertical and horizontal adjustment of the striker pin and its path of movement relative to the vehicle frame during installation to accurately align the pin with the path of movement of the door carried latch.

SUMMARY OF THE INVENTION

A striker pin drive mechanism embodying the present invention includes a base plate having a horizontal slot opening at one side of the base plate and a vertical slot opening at the opposite side of the base plate. A striker pin carrying slider is received within the horizontal slot for horizontal sliding movement and is formed with a cylindrical post like projection which projects from one side of the slider freely through a horizontally elongate opening in the base plate and the vertical slot at the opposite side of the base plate. A striker pin is threadably received in a tapped bore extending through the slider and post portion with the pin projecting perpendicularly from the opposite side of the slider away from the base plate. A retainer plate overlies the horizontal slot in the base plate to retain the slider within the slot and a horizontally elongate opening through the retainer plate provides clearance for the necessary horizontal movement of the striker pin. The retainer plate is formed with two or more vertically elongate mounting bolt receiving openings which accommodate vertical adjusting movement of the retainer plate relative to the door frame member upon which the mechanism is to be mounted. The base plate is formed with corresponding enlarged mounting bolt receiving openings which accommodate horizontal adjustment of the base plate relative to the retainer plate. The base plate and retainer plate are clamped to the door frame in an adjusted position by bolts located in holes fixedly located on the door frame which are threadably received in nuts seated against that side of the base plate remote from the door frame member.

The cylindrical post portion of the slider which projects through the vertical slot in the base plate is rotatively received within a bore eccentrically located in a circular cam disposed within the vertical slot in the base plate. In one form of the invention, the circular cam is rotatably received within a bore in a slider member slidably received within the vertical slot of the base plate for vertical movement relative to the base plate. In other forms of the invention, the circular cam may be rotatively received within the bore of a plain bearing whose outer periphery is in rolling engagement with the side walls of the vertical slot or alternatively a ball bearing having an inner race rotatively locked to the circular cam and an outer race in rolling engagement with the slot side walls may be employed.

A preferred form of drive includes a flexible cable having one end fixedly secured to the circular cam and trained partially around the periphery of the cam with the opposite end of the cable being fixed to a drum like member driven in rotation by an electric motor. Tensioning of the cable applies a torque which, because of the motion constraints imposed by the horizontal and vertical slots in the base plate, acts to drive the circular cam in rotation about the axis of the post portion of the slider and hence the axis of the striker pin. The horizontal component of this rotary movement is applied to the striker pin carrying slider to drive the slider and pin in horizontal movement, while the vertical component of the rotary movement shifts the circular cam vertically relative to the stationary base plate.

The cable, circular cam and the eccentric bore through the cam which rotatively receives the post portion of the striker pin carrying slider are so oriented relative to one another that when the striker pin is at its outboard limit of movement, the center of the circular cam, the striker pin axis, and the point at which the cable first tangentially engages the periphery of the circular cam all lie on a common horizontal line with the pin located between the center of the cam and the cable. From its point of tangential engagement with the cam, the cable extends for at least 180° about the periphery of the cam with the parts in the foregoing orientation. With this arrangement, the leverage or mechanical advantage of the system is proportional to the horizontal distance between the point at which the cable tangentially engages the cam and the axis of the striker pin. This horizontal distance progressively increases as the cam rotates about the striker pin axis, hence a maximum mechanical advantage is present as the striker pin approaches its inboard position.

In one form of the invention, a single cable is employed and is tensioned by a motor driven rotary drum. A torsion spring engaged between the post portion of the striker pin carrying slider and the circular cam is employed to return the mechanism to its start position. In another form of the invention, two cables are partially trained in opposite directions about the circular cam and fixedly attached at their opposite ends to a winding drum coupled to be driven by a reversible electric motor.

Other objects and features of the invention will become apparent by reference to the following specification and to the drawings.

BRIEF DESCRIPTION OF THE DRAWINGS

The striker pin actuating mechanisms of the present invention are well adapted for use in cooperation with the latching mechanisms utilized at the rearward edge of a sliding door of the type employed in automotive vans. In FIGS. 1–3, one form of the invention is shown assembled to a vehicle body frame member F which defines the rearward edge of the sliding door opening in the passenger side of the van. As best seen in FIGS. 1 and 3, the frame member F is formed with a horizontally elongate opening 30 through which a striker pin 32 freely projects from a mechanism housing designated generally 34 which is fixedly mounted upon the inner or rearward side of the generally channel shaped frame member F. As here employed, the terms front, rear, forward, rearward, etc., correspond to the front and rear of the vehicle whose fore and aft centerline extends parallel to the portions F1 and F2 of frame F (FIG. 3). The cross sectional configuration of the frame member F which defines the rear edge of the door opening will vary somewhat between various vehicle manufacturers, the frame member F shown in cross section in FIG. 3 being a generalized typical frame configuration in which the striker pin 32 is mounted upon a frame portion F lying in a general vertical plane which is inclined inwardly and forwardly relative to the fore and aft axis of the vehicle. The general path of movement of the rearward edge of the door toward its closed position is indicated in FIG. 3 by the line DP, the final phase of movement of the door to its fully closed position being along a path substantially parallel to the general plane of frame section F3. As the sliding door moves along this last section of its path, a latch mechanism carried by the door snaps into place around the shank of striker pin 32 when the pin is in the outboard or ready position shown in FIG. 3. With the door now latched to the striker pin 32, the pin is driven by power driven mechanism to be described below from the full line outboard position shown in FIG. 3 to the broken line inboard position shown in FIG. 3, this movement of the pin drawing with it the latched door to drive the door to its fully closed position. During this phase of movement of the door, a door seal indicated at S in FIG. 3 is compressed between the door frame F and an opposed surface on the sliding door.

Figure 1:
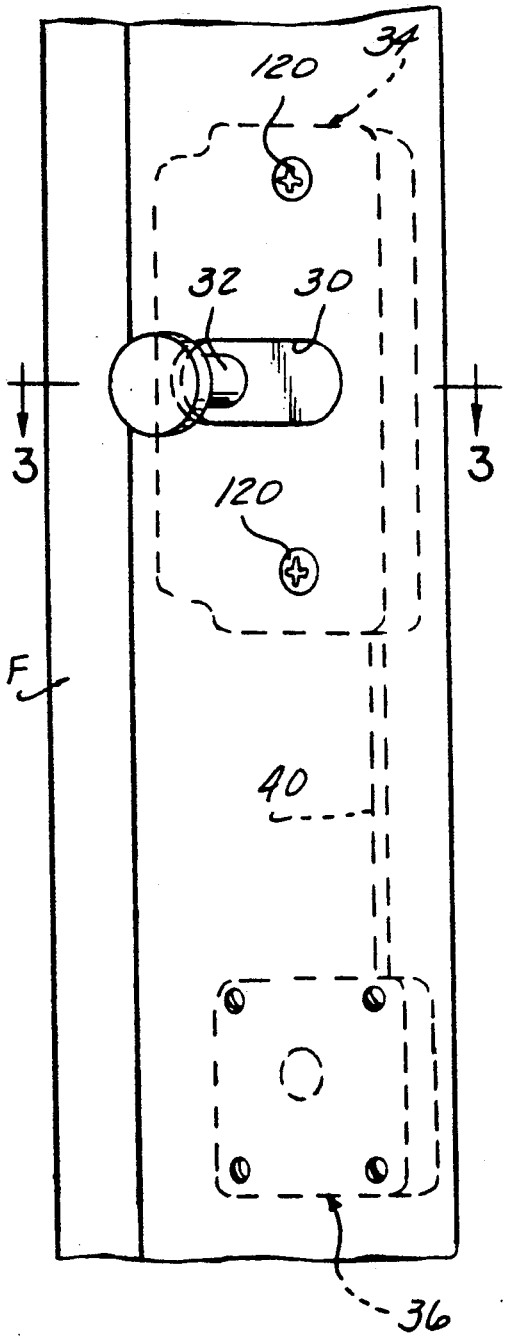
FIG. 1 is a front view of the rear side of a vehicle door frame having a mechanism embodying the present invention, showing the striker pin in its outboard position.

The door carrying latch mechanisms which cooperate with the striker pin may take any of several well known and conventional forms, one example of which is shown in U.S. Pat. No. 4,862,640. Because structure of the door and its latch mechanism is well known and conventional, details of the door and latch have not been shown in the drawings.

Figure 2:
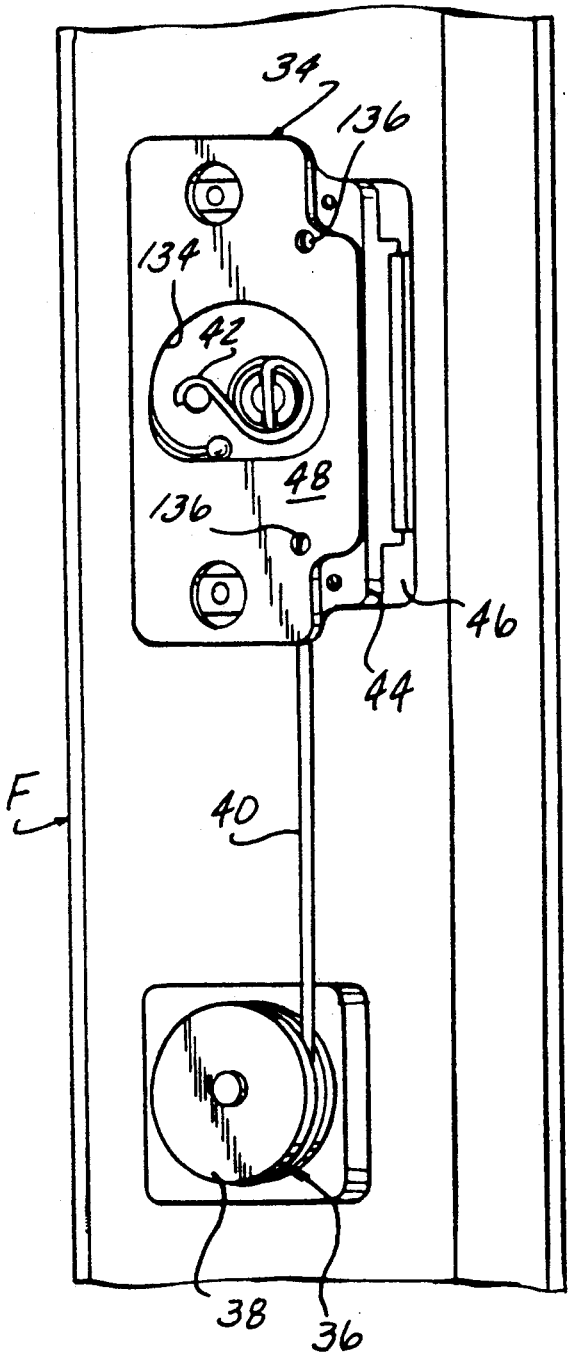
FIG. 2 is a rear view of the structure shown in FIG. 1.
Figure 3:
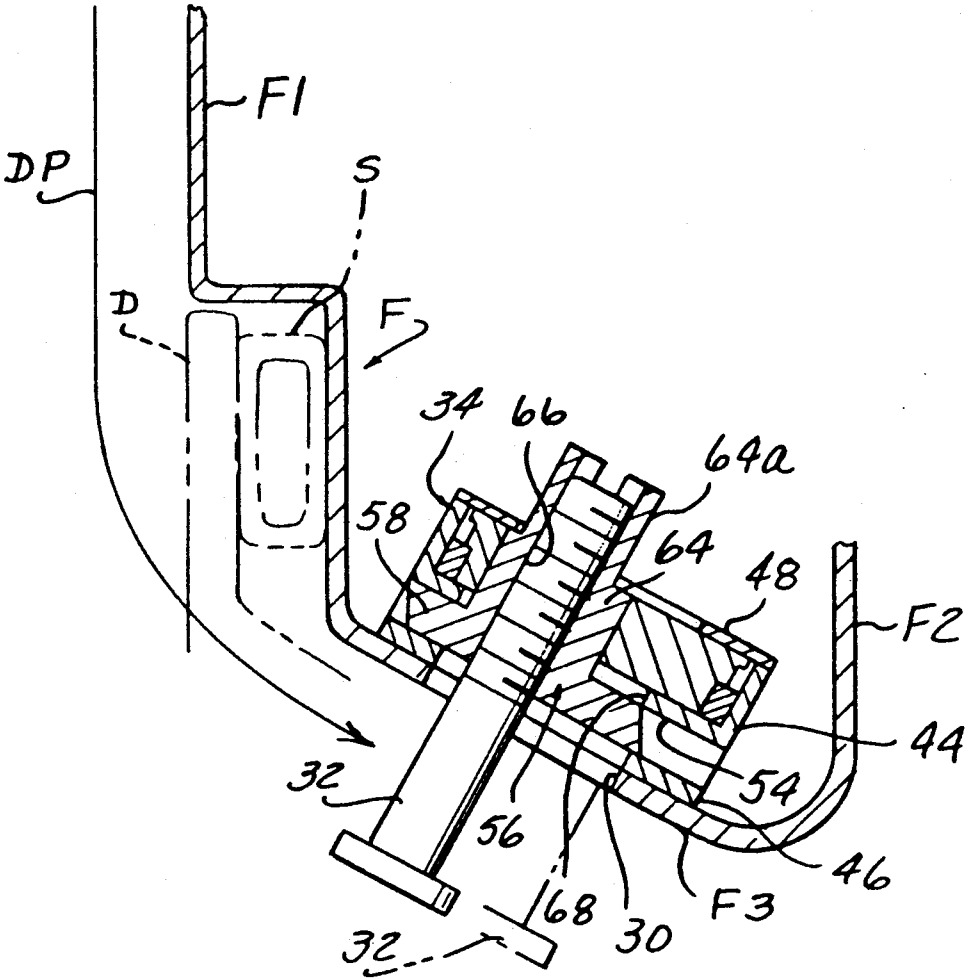
FIG. 3 is a detailed cross sectional view taken approximately on the plane 3—3 of FIG. 1.

In the embodiment of the invention shown in FIGS. 1-3, striker pin 32 is mounted for horizontal movement relative to its mechanism housing 34 and is driven in the door closing direction by a drive motor 36 having a winding drum 38 coupled to mechanism within housing 34 by a flexible cable 40. In this form of the invention, the motor 36 drives in a direction which drives the striker pin 32 from its outboard (with respect to vehicle centerline) latch receiving ready position to its inboard holding position, while the pin is returned to its outboard ready position upon opening of the door by the action of a torsion spring 42 in a manner described more fully below.

Mechanism housing 34 is made up of three separate members, namely a base plate 44 which is sandwiched between a retainer plate 46 and a cover plate 48. Base plate 44 functions to constrain and guide movable elements of the striker pin shifting mechanism, while retainer plate 46 and cover plate 48 overlie recesses in the front and rear sides respectively of base plate 44 to retain various movable parts of the mechanism within base plate 44.

Figure 4:
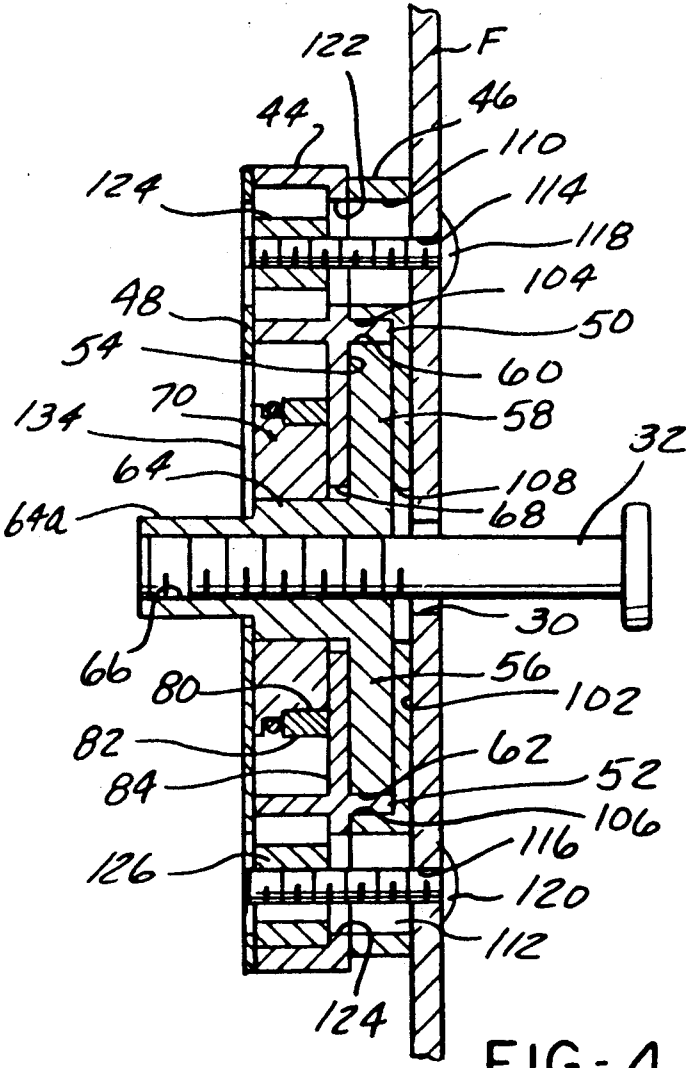
FIG. 4 is a detailed cross sectional view of the mechanism of FIG. 3 taken in a vertical plane.
Figure 5:
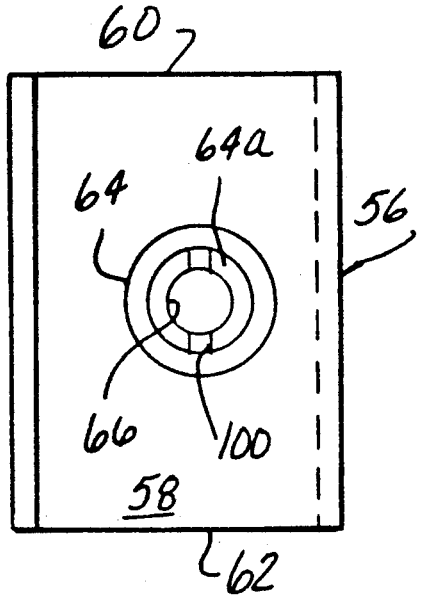
FIG. 5 is a rear elevational view of a striker pin carrying slider.
Figure 6:
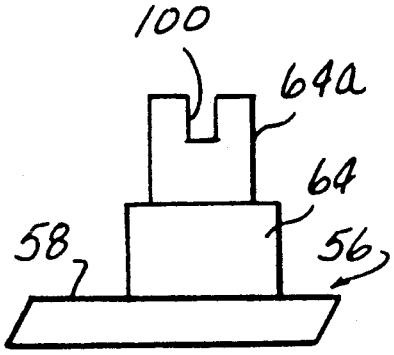
FIG. 6 is a top plan view of the slider of FIG. 5.
Figure 7:
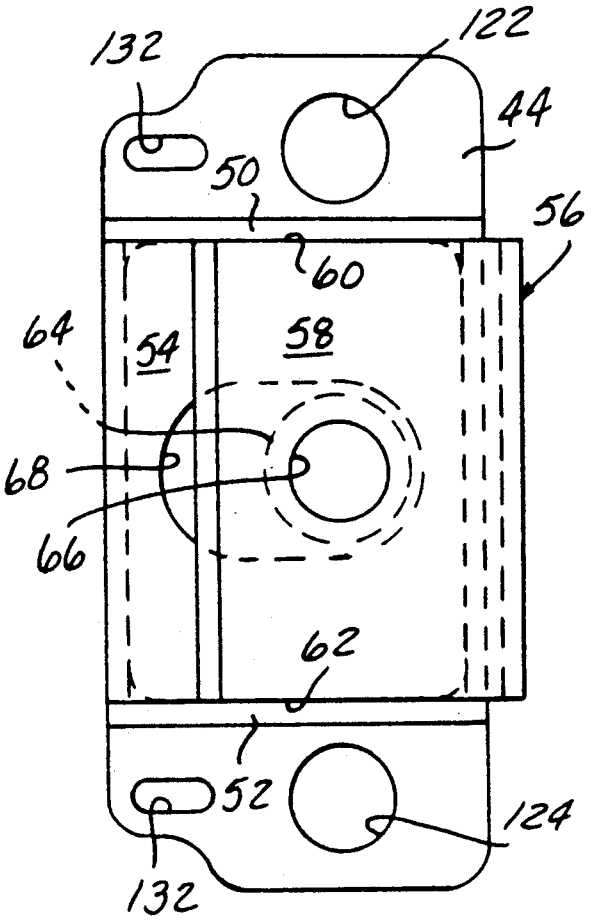
FIG. 7 is a front view showing the slider of FIG. 5 mounted in the base plate of the mechanism.
Figure 8:
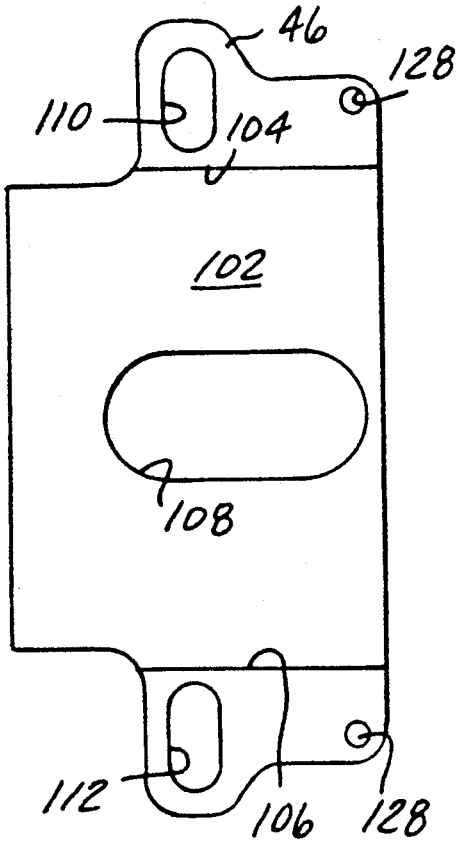
FIG. 8 is a front view of a retainer plate.

As best seen in FIGS. 4 and 7, a pair of flat sided horizontal ribs 50, 52 project forwardly from the front side of base plate 44 to define a horizontal slot 54 between ribs 50 and 52 which extends entirely across the front side of base plate 44. A striker pin carrying slider designated generally 56 is formed with a flat base portion 58 having parallel upper and lower edges 60 and 62 adapted to be slidably received between the ribs 50 and 52 respectively of base plate 44, the ribs 50 and 52 guiding base portion 58 of slider 56 in horizontal movement across the front face of base plate 44 within slot 54. As best seen in FIGS. 5 and 6, a stepped cylindrical post portion 64, 64A is formed integrally with base portion 58 of slider 56 and projects rearwardly from the rearward side of base portion 58. A tapped bore 66 extends rearwardly through base portion 58 and post portion 64, 64A of slider 56 to threadably receive striker pin 32. As best seen in FIGS. 4 and 8, the post portion 64, 64A of striker pin carrying slider 56 projects freely rearwardly through a horizontally elongate opening 68 through base plate 44.

Figure 9:
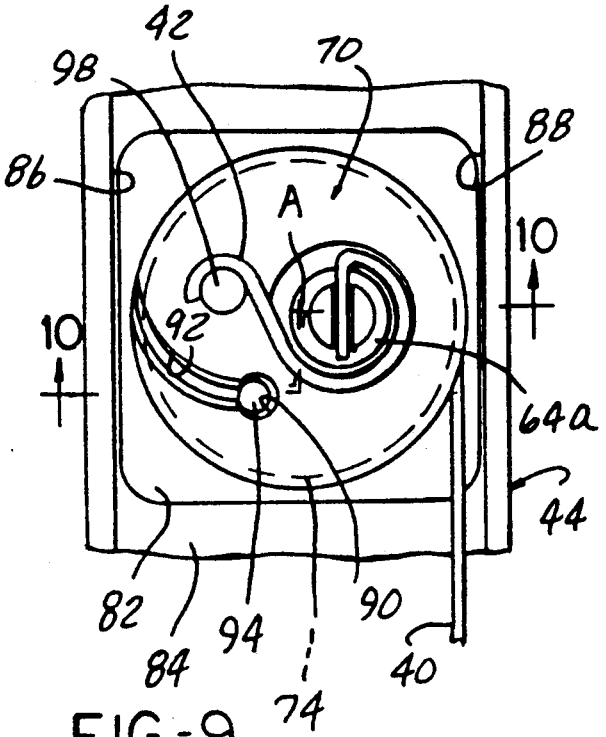
FIG. 9 is a rear view of one form of circular cam employed by the present invention.
Figure 10:
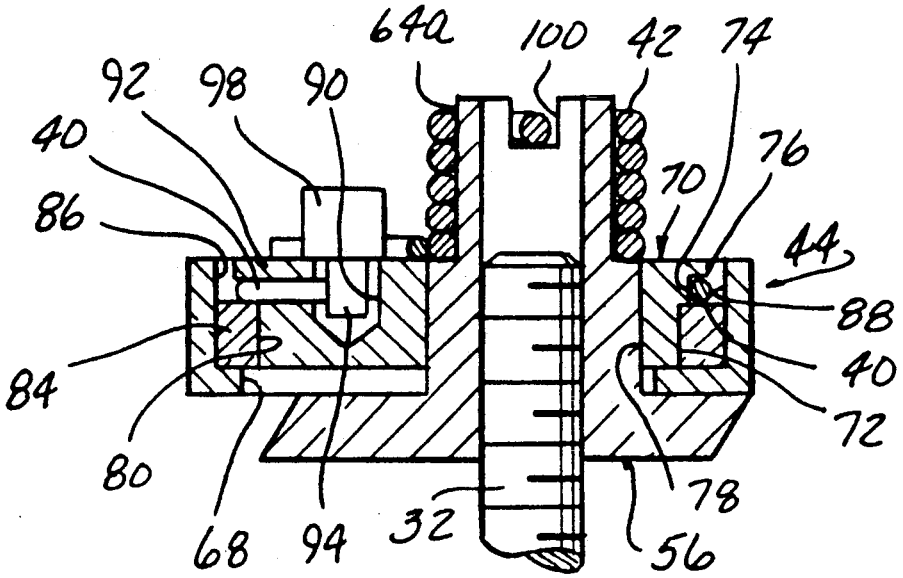
FIG. 10 is a side elevational view of the cam of FIG. 9, showing in cross section a portion of the base plate and a cam carrying slider in their assembled relationship with the cam.

Horizontal movement of the striker pin carrying slider 56 relative to base plate 44 is induced by a circular cam designated generally 70 whose structure is best seen in FIGS. 9 and 10. As best seen in FIG. 10, the cam is formed with three coaxial cylindrical portions 72, 74 and 76 of progressively increasing diameter from the front face of the cam to its rear face. An eccentric bore 78 extends axially through cam 70. The diameter of eccentric bore 78 is such as to rotatively receive post portion 64 of the cam carrying slider 56 with a sliding fit which enables cam 70 to rotate upon post portion 64.

Figure 12A:
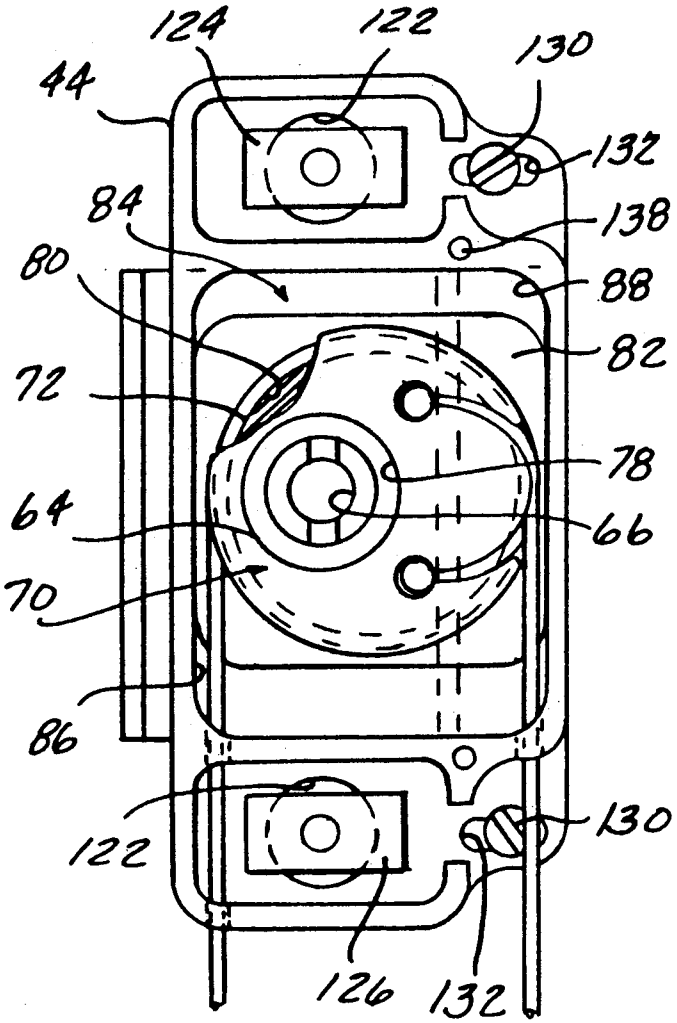
FIG. 12*a* is a rear view similar to FIG. 12, showing the cam of FIG. 9 and a cam carrying slider assembled to the parts shown in FIG. 12.
Figure 12:
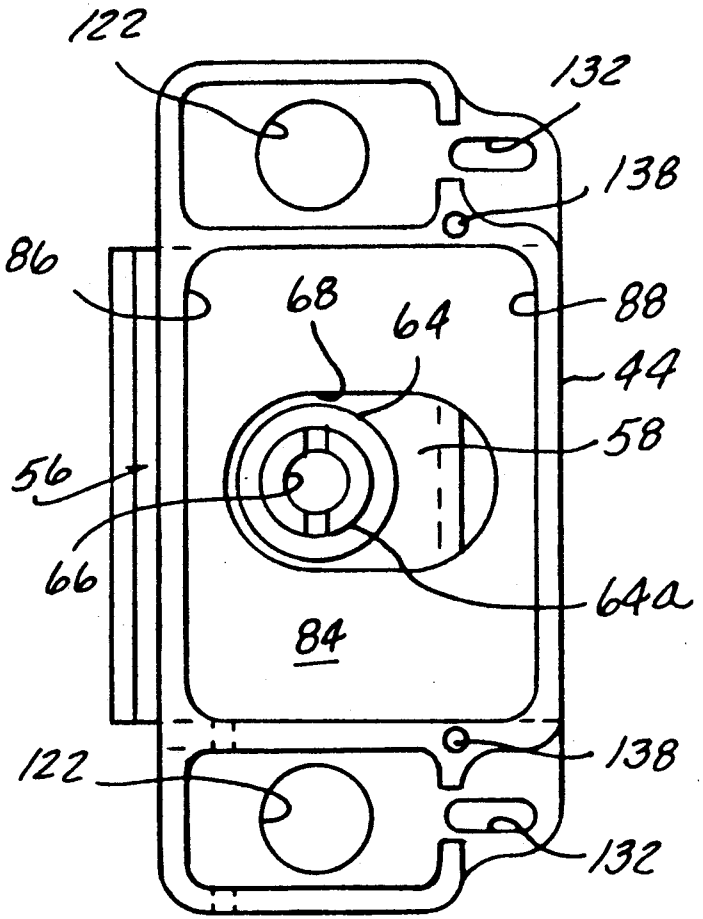
FIG. 12 is a rear view of the striker pin slider and base plate in their assembled relationship with each other.

In a preferred form of the invention, the small diameter portion 72 of cam 70 is rotatively seated within a bore 80 in a generally square cam carrying slider 82. As best seen in FIGS. 8 and 12, the rearward side of base plate 44 is formed with a vertically elongate recess 84 having opposed parallel vertical side walls 86, 88 between which the cam carrying slider 82 is slidably received. The sliding engagement between the opposed side edges of slider 82 and the vertical walls 86, 88 of recess 84 constrains slider 82 to vertical movement only relative to base plate 44, hence the central axis A (FIG. 9) of cam 70, which is fixed relative to slider 82, can also move only vertically relative to base plate 44.

Figure 18:
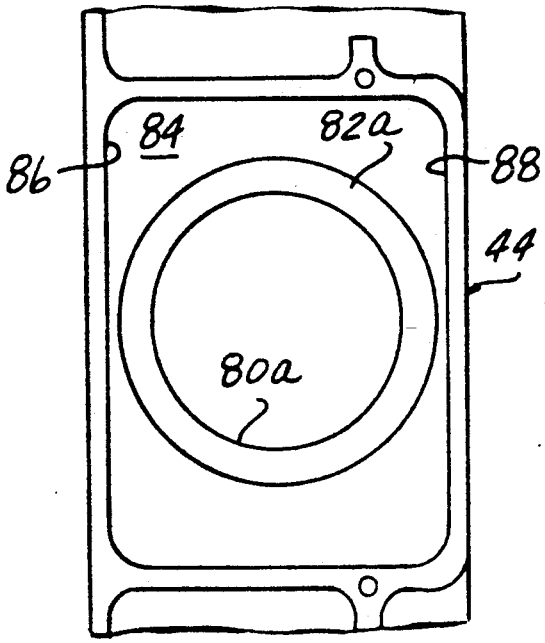
FIG. 18 is a rear view of an alternative cam carrying structure.
Figure 19:
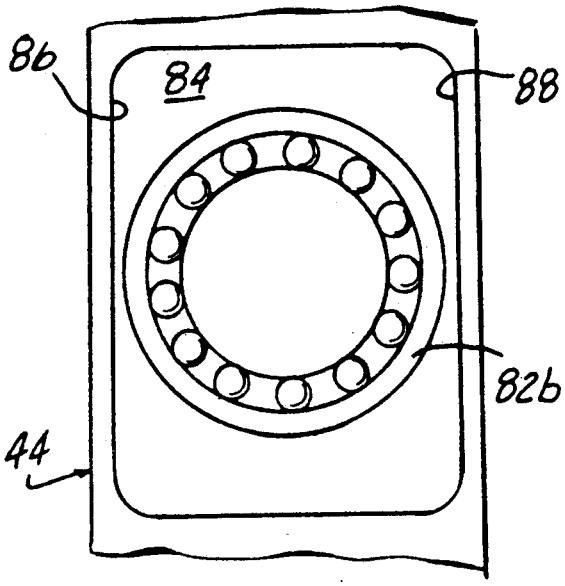
FIG. 19 is a rear view of a third form of cam carrying structure.

Alternative forms for mounting cam 70 within recess 84 are shown in FIGS. 18 and 19. In FIG. 18, slider 82 is replaced by a plain bearing 82*a* having a central bore 80*a* dimensioned to rotatively receive the small diameter portion 72 of cam 70. The outer diameter of bearing 82*a* is slightly less the horizontal distance between the opposed vertical sides 86, 88 of recess 84 so that bearing 82*a* can roll freely upwardly or downwardly along one or the other of walls 86, 88. Instead of employing a plain bearing such as 82*a*, the cam may be mounted within the inner race of a ball bearing 82*b* as shown in FIG. 19 which likewise is received with a slight clearance between the vertical walls 86, 88 of recess 84.

Driving of striker pin 32 between its inboard and outboard positions is accomplished by rotation of the circular cam 70. In a preferred form of the invention, rotation of cam 70 is accomplished by fixedly securing one end of a flexible cable 40 to the cam, training the cable partially around the circumference of the cam and connecting the opposite end of the cable to a winding drum. Referring now particularly to FIGS. 9 and 10, in one arrangement, cam 70 is formed with a bore 90 extending axially inwardly from the large diameter 76 end face of the cam. An arcuate groove 92 extends, as best seen in FIG. 9, from bore 90 outwardly to merge with the periphery of the cam. The depth of groove 92 extends from the large diameter end face of the cam at least to the small diameter portion 72 of the cam. The flexible cable 40 is trained around the intermediate diameter 74 portion of the cam and inwardly through groove 92 into bore 90. A cylindrical enlargement 94 fixedly secured to the end of cable 40 fits into bore 90 to fixedly anchor this end of cable 40 to the cam. Cable 40 extends tangentially from the cam periphery along a vertical path tangent to the cam at a point horizontally aligned with the cam axis.

A torsion spring 42 has one end engaged against a post 98 fixedly secured to cam 70 at a location off set from the center of the cam. The spring 42 is wound about post portion 64*a* of the striker pin carrying slider 56 with the other end of spring 42 seated in a slot 100 (FIG. 10) in post portion 40. The spring 42 is so oriented as to bias cam 70 in a counterclockwise direction as viewed in FIG. 9 about post portion 64*a*, while tension applied to cable 40 will tend to rotate cam 70 in a clockwise direction about post portion 64*a*.

Figure 11:
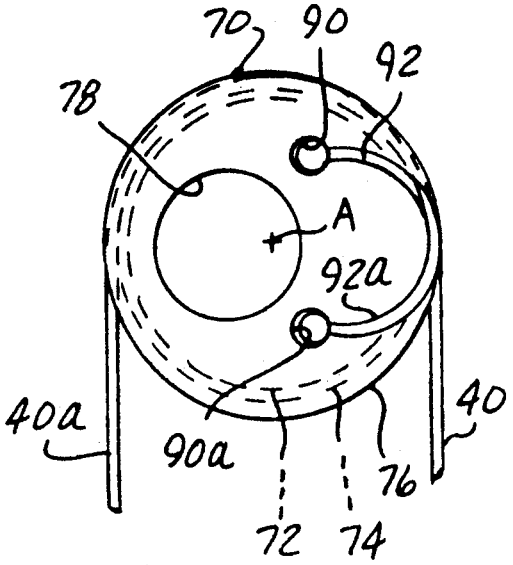
FIG. 11 is a rear view of an alternative form of circular cam.

In another arrangement, shown in FIG. 11, the cam 70 may be formed with a second bore 90*a* and arcuate slot 92*a* and a second cable 40*a* may be trained around the cam in the opposite direction to have its end anchored in bore 90*a*. In this arrangement, tensioning of cable 40 tends to rotate the cam 70 in one direction, while tensioning of the other cable 40*a* tends to rotate the cam in the opposite direction. The opposite ends of cables 40 and 40*a* may be trained in opposite directions around a common winding drum so that rotation of the drum in one direction tensions one cable and provides slack to the other.

In FIG. 8, the rear face of retainer plate 46 is shown. The rear face of plate 46 is formed with a horizontal slot 102 extending entirely across the rear face between parallel horizontal upper and lower edges 104, 106. As best seen in FIG. 4, the depth of slot 102 is equal to the amount by which horizontal ribs 50, 52 of base plate 44 project forwardly from the base and the upper and lower edges 104, 106 of the slot in retainer plate 46 are spaced from each other by a distance such that the ribs 50 and 52 of base plate 44 fit snugly but slidably between edges 104 and 106 when the base plate and retainer plate are assembled to each other.

Retainer plate 46 is also formed with a horizontally elongate striker pin clearance opening 108 and a pair of vertically elongate mounting bolt receiving holes 110, 112. As best seen in FIG. 4, the door frame F is bored as at 114, 116 to snugly receive mounting bolts 120 which project through the respective holes 110, 112 in retainer plate 46 and through enlarged openings 122, 124 in base plate 44 to be threaded into nuts 124, 126 seated against the rear face of base plate 44. The vertical elongation of holes 110, 112 in retainer plate 46 accommodates vertical adjustment of retainer plate 46 relative to the frame as may be required to locate striker pin 32 vertically within slot 30 in frame F. The engagement between ribs 50, 52 of base plate 44 with the side walls 104, 106 of slot 102 in retainer plate 46 accommodates horizontal adjustment of base plate 44 relative to retainer plate 46 and to frame F to accurately locate striker pin 32 horizontally relative to slot 30 in the frame F. The plate like base portion 58 of striker pin carrying slider 56 is retained in slidable engagement with the front face 54 of base plate 44 by retainer plate 46.

Retainer plate 46 is also formed with a pair of tapped bores 128 which receive mounting shoulder screws 130 (FIG. 12) which pass forwardly through horizontally elongate openings 132 in base plate 44 to fix base plate 44 in horizontally adjusted relationship to retainer plate 46.

The rearward face of base plate 44 is closed by a cover plate 48 formed with an opening 134 providing clearance for the projecting post portion 64*a* of the striker pin carrier. Cover plate 48 is secured to base plate 44 as by mounting screws 136 (FIG. 2) threadably received in tapped bores 138 (FIGS. 12 and 12*a*) in the rear face of base plate 44.

Figure 13:
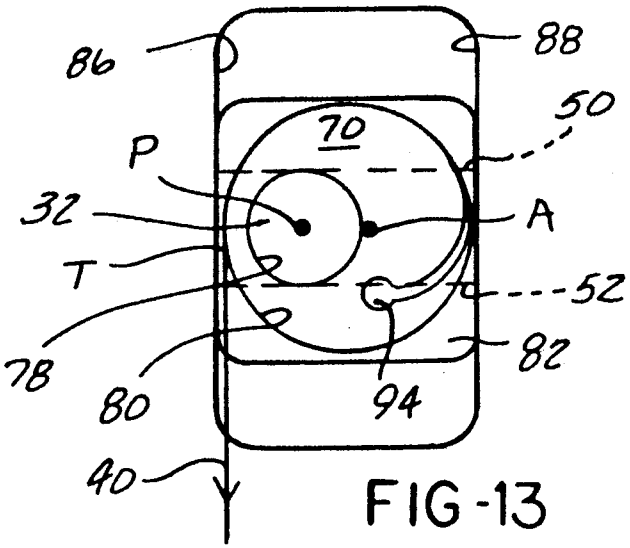
FIGS. 13–17 inclusive are schematic diagrams showing successive steps of movement of the striker pin mechanism.
Figure 14:
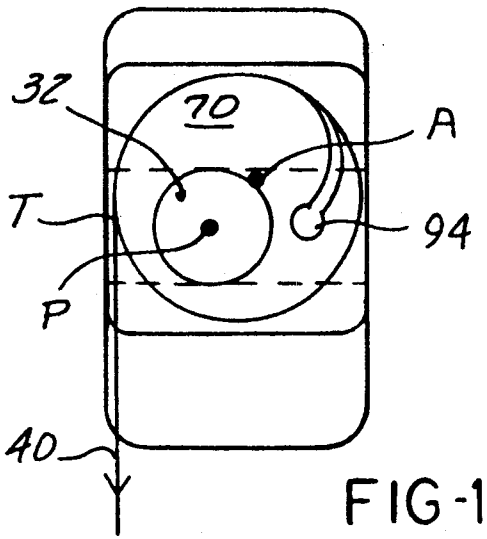
Figure 15:
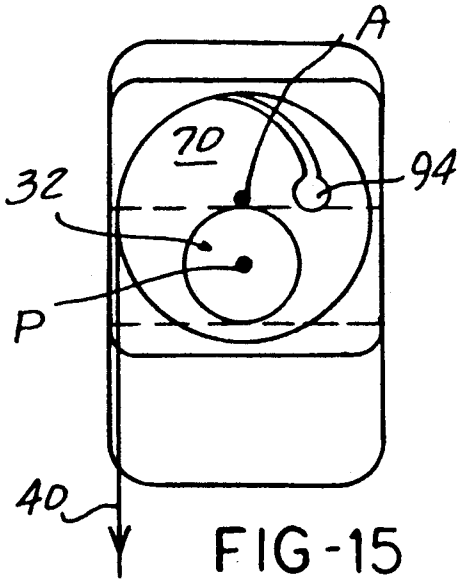
Figure 16:
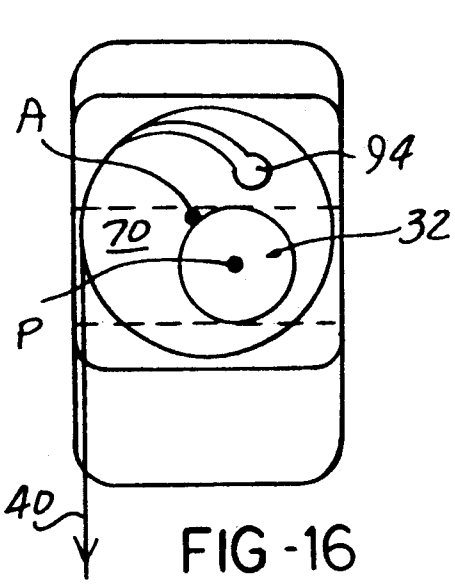
Figure 17:
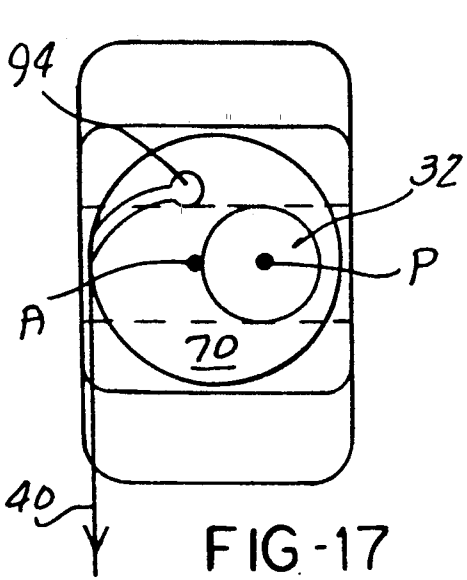

The manner in which the mechanism described operates to shift the striker pin 32 between its outboard ready position and its inboard holding position is best seen in the schematic diagrams of FIGS. 13–17. The views of FIGS. 13–17 schematically represent a front view of circular cam 70 mounted in cam carrying slider 82 with striker pin 32 rotatively received within the eccentric bore 78 through the cam. In FIGS. 13–17, the striker pin carrying slider 56 and its post portion 64 which is rotatively received in bore 78 of cam 70 are schematically represented by the striker pin 32. The vertical constraint of movement of slider 82 is indicated in these Figures by the vertical side walls 86, 88 of the recess in base plate 44, while the horizontal constraint of motion of the striker pin 32 is schematically indicated by the horizontal dotted lines indicated at 50 and 52 in FIG. 13. Only the single cable 40 is shown. In FIG. 13, the mechanism is in the orientation which locates striker pin 32 in its outboard or ready position, with the center A of circular cam 70, the center P of striker pin 32 and the point T at which cable 40 tangentially engages the periphery of cam 70 all lying on a common horizontal line with the pin axis P located between the cam center A and point T.

With the parts positioned as in FIG. 13, the application of a downward force tensioning cable 40 applies a torque to cam 70 which urges the cam to rotate in a counterclockwise direction as viewed in FIG. 13. Cam 70 is free to rotate about its center A relative to slider 82 and is freely rotatable (about post portion 64 of slider 56) relative to striker pin 32 about the center P of the striker pin, however, both of these rotary degrees of freedom are constrained by the vertical and horizontal constraints imposed respectively by the walls 86, 88 (on the cam carrying slider 82) and surfaces 50, 52 of the base plate (guiding striker pin carrying slider 56). Counterclockwise rotation of cam 70 from its FIG. 13 position tends to move striker pin 32 downwardly, however, this downward movement is prohibited by the schematically illustrated engagement of the pin with the fixed horizontal surface 52. Because pin 32 cannot move downwardly, cam 70 must move upwardly, and upward movement of cam 70, or at least the vertical component of upward movement of cam 70 is accommodated by upward sliding movement of slider 82 along surfaces 86, 88 of the fixed base plate.

The torque applied by the tension of cable 40 causes circular cam 70 to rotate in a counterclockwise direction about the center P of striker pin 32 with the center A of cam 70 attempting to move along a circular arc centered at the striker pin center P. This rotary movement, if unconstrained, includes a sinusoidally increasing horizontal component of movement urging cam 70 to the left as viewed in FIG. 13, however, this leftward horizontal movement of cam 70 is prohibited by the engagement between the cam carrying slider 82 and side wall 86 of the fixed base plate. Because cam 70 cannot move to the left relative to the base plate, striker pin 32 must move to the right, a horizontal motion which is accommodated by the horizontal pin guiding surfaces 50 and 52 of the base plate.

Continued application of torque by the tensioning of cable 40 causes cam 70 to rotate in a counterclockwise direction about the center P of striker pin 32 and to also rotate in a counterclockwise direction about its center A relative to slider 82 successively to the positions shown in FIGS. 14, 15, 16 and 17. The vertical and horizontal constraints imposed by the base plate surfaces 86, 88 and 50, 52 transform these rotary movements into vertical motion of slider 82 and horizontal motion of striker pin 32. With the mechanism in the position shown in FIG. 17, striker pin 32 is in its inboard position.

The geometry of the mechanism diagramed in FIGS. 13–17 is such that the force applied to pin 32 which moves the pin horizontally to the right as viewed in FIGS. 13–17 is applied with a mechanical advantage which steadily increases as the pin moves toward its inboard position. The force exerted is derived from the tension applied to cable 40, and this tension force is multiplied by a moment arm M which is equal to the horizontal displacement of the striker pin center P from the point T at which the vertical force is effectively applied to the rotary cam. It can be shown that this moment arm $M = R - R1 \cos \phi$ where R is the radius of the circular cam — i.e., the distance AT, R1 is the distance AP between the center A of cam 70 and the center P of striker pin 32, and $\phi$ is the angle by which cam center A is angularly displaced about the striker pin center P from the start position shown in FIG. 13. In FIG. 13, $\phi$ is 0, in FIG. 14, $\phi$ is 45° and in FIGS. 15, 16 and 17, $\phi$ is 90°, 135° and 180° respectively. Thus, at the start position, i.e., outboard position of the pin in FIG. 13, the moment arm M is equal to R−R1, is equal to R at the 90° position of FIG. 15, and is equal to R+R1 at the 180° position of FIG. 17. This progressive force increase over the entire inboard movement of the pin in combination with the sinusoidal cam force action readily overcomes the progressively increasing resistance exerted against closing movement of the door by its resilient door seal during the final phase of movement of the door by the pin to its fully closed position.

The horizontal striker pin slider slot 54 defined by ribs 50, 52 and the vertical guide slot 84 defined by side walls 86, 88 on base plate 44 effectively prevent external forces applied to the striker pin from displacing the movable elements of the striker pin drive mechanism, both when the pin is in its inboard or holding position, or outboard or ready position. Vertical components of such forces are absorbed by the engagement between the upper and lower edges 60, 62 of the striker pin slider and the ribs 50, 52 on base plate 44 which are in turn braced against vertical movement by the upper and lower walls 104, 106 of retainer plate 46. Horizontal components of such forces are transmitted from striker pin 32 to circular cam 70 which is in turn restrained against horizontal movement by cam slider 82 engaged between the vertical side walls 86, 88 on base plate 44. When pin 32 is at either of its inboard or outboard positions, such horizontal force components act through the center of cam 70 so that there is no tendency for the cam to rotate and backdrive the drive motor 36.

Figure 20:
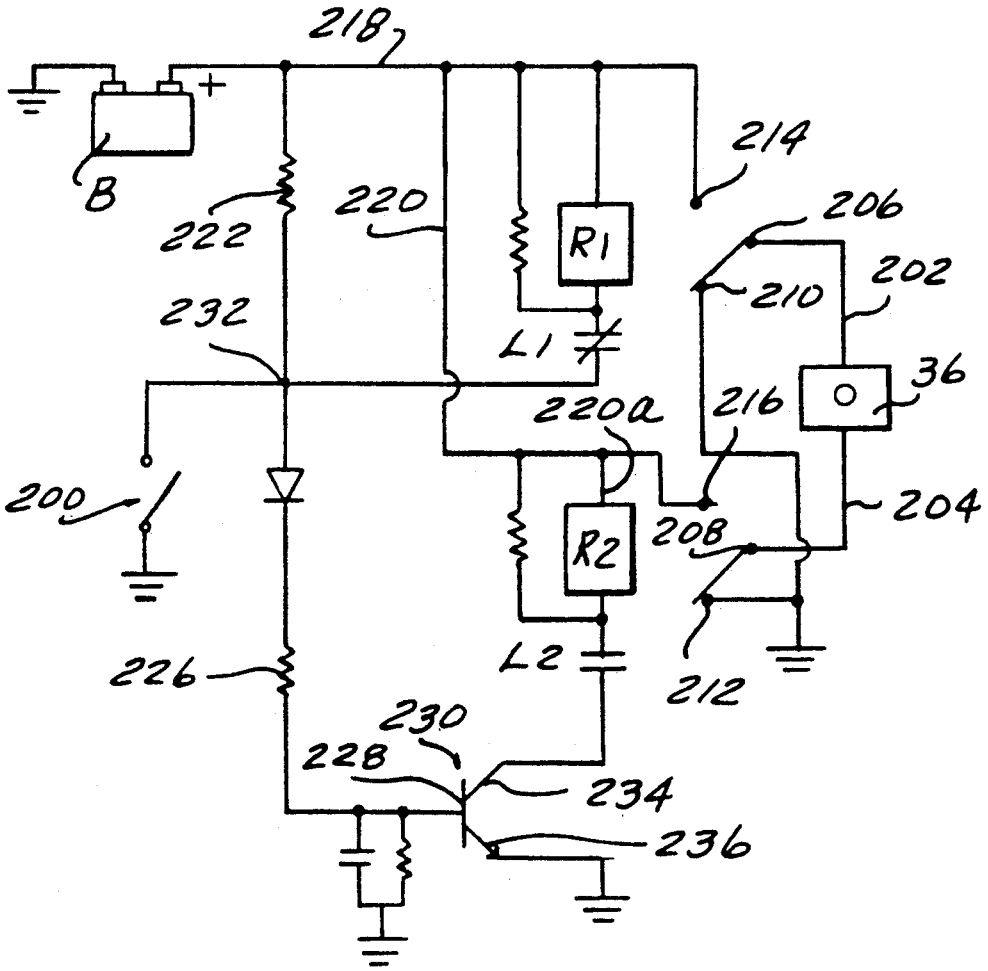
FIG. 20 is a schematic diagram of an electric control circuit for the striker drive motor.

One form of control circuit for controlling operation of the striker pin drive motor 36 is shown in FIG. 20.

The circuit of FIG. 20 includes a door actuated switch 200 which may take the form and operate in the same manner as the conventional door switch employed to switch on lights in the vehicle interior when the door is opened. This switch includes a plunger projecting through the door frame to be depressed by the door as the door approaches its fully closed position, the plunger when depressed opening the switch contacts and permitting the contacts to close when the door is moved away from its closed position. Alternatively, switch 200 may be mounted on the door to be actuated by the latch mechanism to a switch open position when the latch is latched and a switch closed position when the latch is released.

The circuit also includes a pair of striker pin actuated limit switches L1 and L2. Limit switch L1 is a normally closed switch which opens when the striker pin is in its outboard position. Limit switch L2 is illustrated as a normally open switch, but is related to the striker pin so that it is closed at all times which the pin is not at its inboard position and is open only when the pin is at its full inboard position.

In FIG. 20, the electrical connections of the various switches of the circuit are those which are established when the sliding door is fully closed and latched to striker pin 32 with pin 32 in its inboard or holding position.

At this time, switch 200 is held open by the closed door, if switch 200 is door actuated or by the latched latch if switch 200 is latch actuated, limit switch L1 is in its normally closed position and limit switch L2 is open because striker pin 32 is at its inboard position.

The opposite sides of motor 36 are connected by leads 202, 204 respectively to the movable switch contacts 206, 208 of switches respectively actuated by relays R1 and R2. When the relays R1 and R2 are deenergized, the movable contacts 206, 208 are in the position shown and engage stationary contacts 210, 212 which are commonly connected to electrical ground. Energization of either relay R1 and R2 will shift the associated movable contact 206 or 208 into contact with a stationary supply contact 214 or 216 connected to the ungrounded or positive side of the vehicle battery B as by leads 218, 220 and to relays R1 and R2 via leads **218*a*, 220*a* respectively. With both relays R1 and R2 deenergized as shown in FIG. 20, the opposite sides of motor 36** are both connected to ground.

Also at this time, the positive side of battery B is connected via resistor 222, diode 224 and resistor 226 to the base 228 of a transistor 230. Diode 224 functions to accommodate current flow from point 232 of the circuit to resistor 226 and to block current flow in the opposite direction. The resistance of resistor 222 and 226 is such that with door switch 200 open, the flow of current to base 228 of transistor 230 is sufficient to connect collector 234 to emitter 236, but is insufficient to energize relay R1, which is electrically connected at this time between lead 218 and point 232 via the normally closed limit switch L1.

Collector 234 of the transistor is connected via limit switch L2 to relay R2, and emitter 236 is connected to ground. Relay R2 is not energized at this time because limit switch L2 is open.

Because the power striker must operate in its intended manner whether the vehicle ignition switch is opened or close, the circuit is supplied at all times with battery power.

Upon opening of the door, the first effect on the control circuit is the closure of door switch 200, whose contacts close when the door moves far enough from its closed position to permit its switch plunger to fully extend.

Closure of door switch 200 connects point 232 of the circuit directly to ground, effectively releasing the closing bias of base 228 of transistor 230 to disconnect collection 234 from emitter 236. Simultaneously relay R1 is energized via its connection to point 23 via the normally closed switch L1 and movable contact 206 shifts to contact 214. Current now flows from contact 214 through contact 206 and motor 36 to ground via contacts 208, 212 to cause motor 36 to drive in a direction moving the striker pin from its inboard position to its outboard position.

As soon as the striker pin moves away from its inboard position, limit switch L2 closes, but relay R2 is not energized because the collector — emitter conductance through transistor 230 has been opened as described above.

Upon arrival of the striker pin at its outboard position, limit switch L1 opens, deenergizing relay R1 to open the circuit to motor 36 by shifting contact 206 back to ground contact 210.

Upon subsequent closing of the door, when the door latch latches to the striker, pin 32 in its outboard position, switch 200 is opened and disconnects point 232 of the circuit from ground. Battery voltage is again applied to base 228 of transistor 230 to make the circuit between collector 234 and emitter 236 conductive. As soon as collector 234 and emitter 236 are conductive, relay R2 is energized because switch L2 is closed. Energization of relay R1 shifts contact 208 into engagement with contact 210 to cause motor 36 to drive in a direction driving the striker pin toward its inboard position.

Motor 36 drives the pin to its inboard position at which time limit switch L2 is opened to deenergize relay R2 and motor 36.

While certain embodiments of the invention have been described in detail above, it will be apparent to those skilled in the art that the disclosed embodiments may be modified. Therefore, the foregoing description is to be considered exemplary rather than limiting, and the true scope of the invention is that defined in the following claims.

What is claimed is:

1. A power striker assembly for driving a striker pin of a door latch in horizontal movement between a ready latch receiving position and an actuated latch holding position, said striker assembly comprising a stationary base plate lying in a first vertical general plane, an elongate striker pin projecting freely through an opening through said base plate with the longitudinal axis of said pin perpendicular to said first general plane, first means mounting said pin upon said base plate for movement relative to said base plate along a fixed horizontal path between said ready position and said actuated position, a drive member lying in a second general plane parallel to said first general plane and having a central axis of rotation perpendicular to said first general plane, said drive member having an eccentrically located bore therein rotatively receiving said striker pin, second means mounting said drive member upon said base plate for rotation relative to said base plate about said central axis between a first and a second rotative position and for movement relative to said base plate along a fixed vertical path, rotation of said drive member between said first and second positions being operable to shift said pin between said ready and said actuated positions, and drive means coupled to said drive member for driving said drive member in rotation between said first and second rotative positions.

2. The invention defined in claim 1 wherein said second means comprises a guide member mounted on said base plate for movement relative to said base plate along said fixed vertical path, and means mounting said drive member upon said guide member for rotation relative to said guide member about said central axis.

3. The invention defined in claim 2 comprising means on said base plate defining a pair of spaced opposed vertical surfaces lying in vertical planes normal to said first general base plane and engageable with opposite sides of said guide member to establish said fixed vertical path.

4. The invention defined in claim 3 wherein said guide member is of generally rectangular configuration having a pair of opposite side walls respectively slidably engaged with said vertical surfaces.

5. The invention defined in claim 3 wherein said guide member is of circular configuration having a peripheral edge surface of a diameter substantially equal to the horizontal distance between said opposed vertical surfaces.

6. The invention defined in claim 3 wherein said guide member is a ball bearing having an outer race engageable with said vertical surfaces and an inner race mounting said drive member for rotation relative to said outer race.

7. The invention defined in claim 1 wherein said first means comprises a first plate-like member lying in a general plane parallel to said first vertical plane and having a pair of parallel opposite side edges, means defining a horizontal slot in one side of said base plate slidably receiving said first member with said side edges of said first member slidably engaged between opposed horizontal side walls of said slot, and a retainer plate secured to said one side of said base plate in overlying relationship to said first member to retain said first member within said slot.

8. The invention defined in claim 7 wherein said retainer plate has a horizontally elongate opening therethrough, said striker pin being fixedly mounted in said first member and projecting perpendicularly from said first member through said opening in said retainer plate and being movable freely within said opening in said retainer plate between said ready and said actuated position.

9. The invention defined in claim 8 wherein said striker assembly is adapted to be mounted on one side of a door frame member with said striker pin projecting from said assembly through an opening in said door frame member, said assembly further comprising first mounting means for fixedly mounting said retainer plate in face to face engagement with said one side of said door frame member, said first mounting means including means accommodating vertically adjustment of said retainer plate relative to said opening in said door frame member without angular misalignment of striker pin travel.

10. The invention defined in claim 9 further comprising second mounting means mounting said base plate on said retainer plate, said second mounting means accommodating horizontal adjustment of said base plate relative to said retainer plate.

11. The invention defined in claim 1 wherein said drive means comprises a first flexible cable trained partially about the circumference of said drive member and fixedly secured at one end to said drive plate, said first cable extending tangentially from said drive member to a drive motor means adapted to be located in fixed relationship to said base plate and selectively operable to apply tension to said first cable, said first cable when tensioned being operable to rotate said drive member in a direction shifting said striker pin from said ready position to said actuated position, and return means operable to rotate said drive member in the opposite direction upon the release of tension in said first cable.

12. The invention defined in claim 11 wherein said return means comprises torsion spring means.

13. The invention defined in claim 11 wherein said return means comprises a second flexible cable trained partially about the circumference of said drive member and fixedly secured at one end to said drive member, said second cable extending tangentially from said drive member to said drive motor means and said drive motor means being selectively operable to apply tension to said first cable or to apply tension to said second cable, said second cable when tensioned being operable to rotate said drive member in a direction shifting said pin from said actuated position to said ready position.

14. The invention defined in claim 11 wherein said first cable tangentially engages said drive member at a point lying on a horizontal line passing through said central axis and said horizontal axis of said striker pin when said striker pin is in its ready position or its actuated position.

15. The invention defined in claim 14 wherein said longitudinal axis of said striker pin is located between said central axis and said point when said striker pin is in its ready position.

16. A power striker assembly for driving a striker pin of a door latch in horizontal movement between a ready latch receiving position and an actuated latch holding position, said strike assembly comprising a base plate lying in a first vertical general plane and having means defining a horizontal guide slot in one side of said base plate and means defining a vertical guide slot in the opposite side of said base plate, said base plate having a horizontally elongate opening therethrough between the respective central portions of said horizontal and vertical slots, a slide member slidably received in said horizontal slot, cylindrical post means on said slide member projecting from said slide member freely through said opening for fixedly mounting said striker pin in said slide member with the longitudinal axis of said striker pin coaxial with the axis of said post means and perpendicular to said first general plane, a circular cam member having a central cam axis and a bore therethrough eccentrically located with respect to said cam axis, guide means mounting said cam member in said vertical slot with said cam axis parallel to said axis of said striker pin and said post means rotatively received within said bore in said cam member, said guide means mounting said cam for rotation relative to said guide means about said cam axis and for vertical movement relative to said base plate, and drive means for driving said cam member in rotation about said cam axis.

17. The invention defined in claim 16 wherein said drive means comprises a flexible cable fixedly secured at one end to said cam member and trained about the periphery of said cam member from said one end to a point on the periphery of said cam member horizontally aligned with said cam axis, said cable extending tangentially of said cam from said point along a vertical path, drive means for driving said cable along said vertical path to apply a torque inducing rotation of said cam member about said cam axis from a first rotative position wherein the axis of said post means lies between said point and said cam axis and said striker pin is in said ready position and a second rotative position wherein said cam axis is located between said point and the axis of said post means and said striker pin is in said holding position.

18. The invention defined in claim 17 wherein said point, said cam axis and said axis of said post means all lie on a common horizontal line when said cam member is in either of said first and second positions.

* * * * *